US005439226A

United States Patent [19]

Luedtke

[11] Patent Number: 5,439,226

[45] Date of Patent: Aug. 8, 1995

[54] TRAINING APPARATUS FOR GOLFERS

[76] Inventor: Fred Luedtke, 16144 Red Coach La., Whittier, Calif. 90604

[21] Appl. No.: 376,222

[22] Filed: Jan. 23, 1995

[51] Int. Cl.[6] ..... A63B 69/36

[52] U.S. Cl. ..... 273/190 R

[58] Field of Search ..... 273/190 R, 190 A, 188 R, 273/189 R, 187.2

[56] References Cited

U.S. PATENT DOCUMENTS

| | | | |
|---|---|---|---|
| 2,469,301 | 5/1949 | Johnston | 273/188 R |
| 3,326,558 | 6/1967 | Eaton, Jr. | 273/190 R X |
| 3,415,524 | 12/1968 | Vickers | 273/189 |
| 3,712,625 | 1/1973 | Taylor | 273/190 R |
| 3,740,051 | 6/1973 | Cross | 273/190 R X |
| 4,659,084 | 4/1987 | Vuick | 273/190 R X |
| 4,998,731 | 3/1991 | Bowen | 273/190 R X |
| 5,039,105 | 8/1991 | Ro | 273/190 R X |

*Primary Examiner*—William H. Grieb
*Attorney, Agent, or Firm*—Edgar W. Averill, Jr.

[57] ABSTRACT

A training apparatus for golfers which assists the golfer to hold the golfer's head steady during his swing. The apparatus has a stand which supports two thin flexible rods which extend outwardly and are positionable against the two sides of the golfer's head. The stand is large enough so that the golfer can take a full swing and the two rods exert pressure against the golfer's head in the event it is moved laterally. Preferably the rods are held by a ball and socket fixture.

4 Claims, 1 Drawing Sheet

20
23
22
24
33

11
19
18
24
25
27
37
17
33
28
32
3
3
34
38
30
20
29
31
21

26
10
32
31
16
15
13
14
12
35
36

TRAINING APPARATUS FOR GOLFERS

BACKGROUND OF THE INVENTION

The field of the invention is athletic training devices and the invention relates more particularly to training devices for assisting a golfer to hold the golfer's head steady during a golf swing. When one watches a professional golfer it is interesting to note that the professional head is essentially motionless during his or her swing. In contrast, if one watches a typical amateur golfer, the golfer's head will move sideways and often up and down during a swing. By simply training the golfer to hold his or her head steady during a swing, the golf swing can be substantially improved.

Numerous golf training devices are known, most of which are relatively elaborate. For instance, the Ro U.S. Pat. No. 5,039,105 has a shoulder guide and a hand guide unit together with a pendulum to assist the golfer in timing his golf swing. The device is sufficiently elaborate so that it could not be purchased by the average golfer and would require professional instruction to use.

The Vuick U.S. Pat. No. 4,659,084 shows a golf swing training apparatus which holds the golfer's legs and also has a member positioned along either side of the golfer's head. This device is also relatively elaborate and not easily used without professional instruction.

BRIEF SUMMARY OF THE INVENTION

It is an object of the present invention to provide a low cost and easy to use training apparatus for golfers which assists the golfer to hold his or her head steady during a swing.

The present invention is for a training apparatus which has a stand supported on the ground which stand includes first and second rod supporting fixtures held at about a golfer's shoulder height. A first thin flexible rod is held by a first rod supporting fixture and the rod extends about horizontally outwardly therefrom and can be adustably positioned against one side of the golfer's head. A second thin flexible rod is held by the second rod supporting fixture and also extends about horizontally and may be adjustably positioned independently of the first thin flexible rod against the other side of the golfer's head, During a swing the flexible rods permit some flexure so that the golfer will be permitted some head movement but will feel the pressure of the rod against the side of the head toward which movement is made. The device may be inexpensively made and is very easy to use without the necessity of professional help.

DESCRIPTION OF THE PREFERRED EMBODIMENTS

Figure 1:
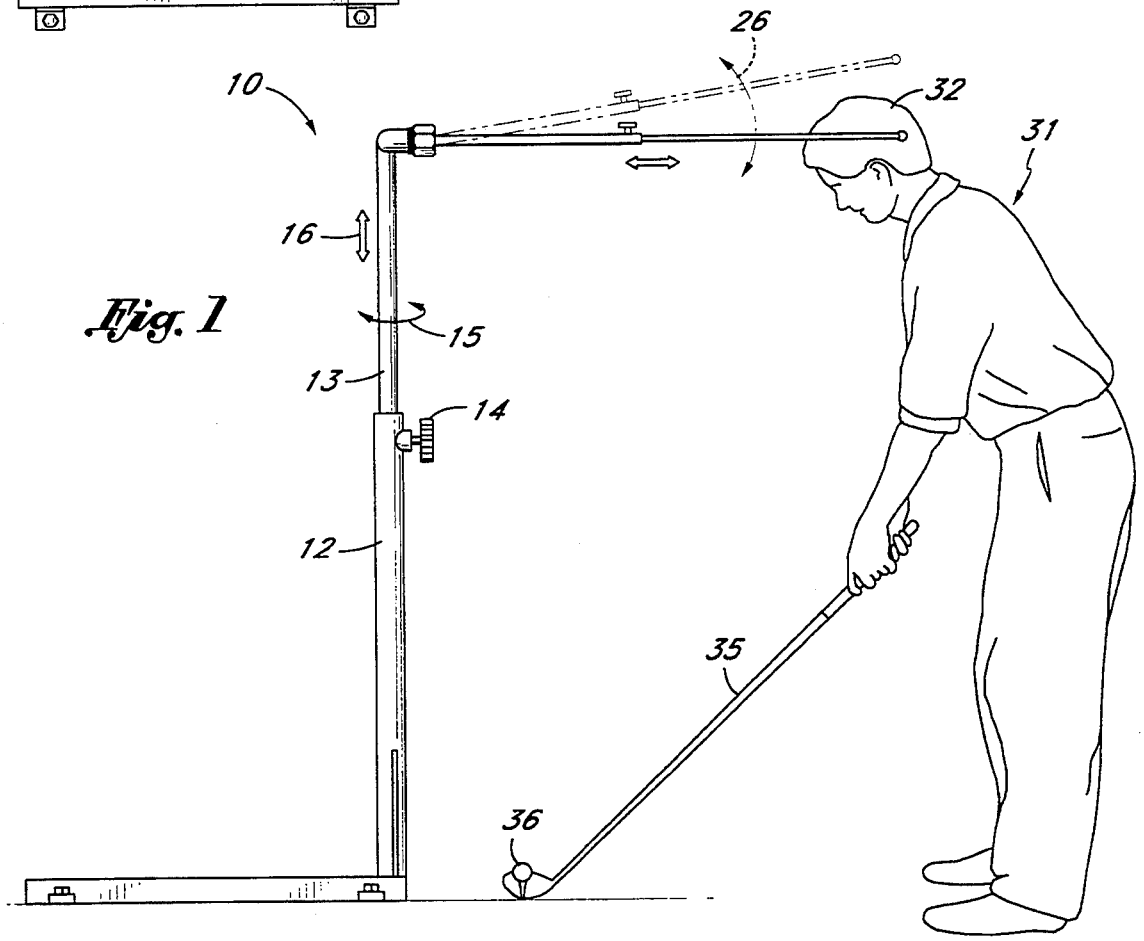
FIG. 1 is a front view of the training apparatus for golfers of the present invention.

The training apparatus for golfers is shown in front view in FIG. 1 and indicated generally by reference character 10. The apparatus has a generally U-shaped base 11 which supports a vertical rod 12 which telescopingly holds a smaller rod 13. Smaller rod 13 may be raised or lowered and held in position by tightening knob 14. This also permits the smaller rod 13 to rotate as indicated by arrow 15. The up and down movement is indicated by arrow 16.

Figure 3:
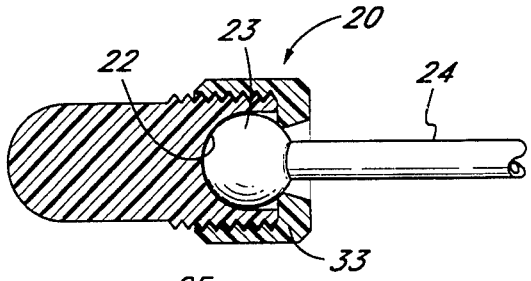
FIG. 3 is an enlarged cross-sectional view taken along line 3—3 of FIG. 2.
Figure 2:
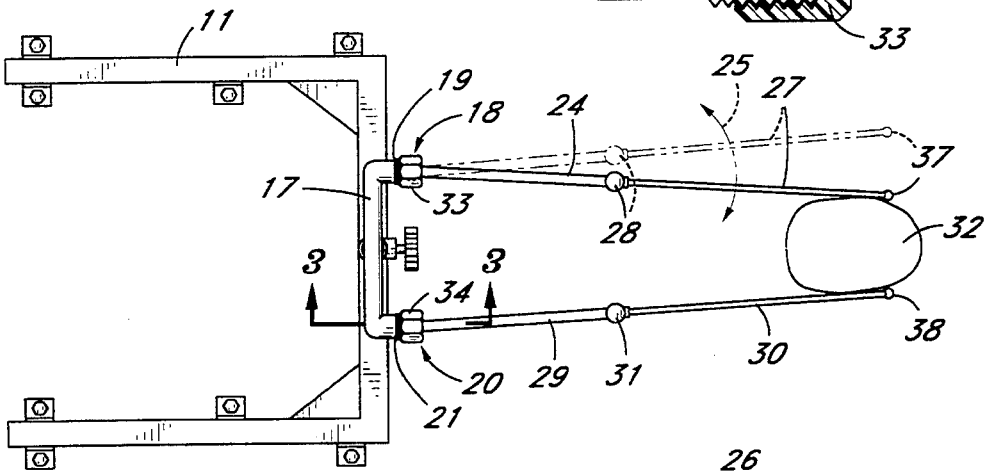
FIG. 2 is a plan view thereof.

As shown in FIG. 2 a generally U-shaped upper member 17 has a first rod supporting fixture 18 held at the terminus 19 of one of the legs of generally U-shaped member 17. Similarly, a fixture 20 is held at the terminus 21 of the second leg of U-shaped member 17. The fixture 20 is shown in cross-sectional view in FIG. 3 where it can be seen that a socket 22 holds a ball 23 which is integral with rod 24. Rod 24 may be moved up and down or backwardly and forwardly as indicated by arrows 25 and 26 in FIGS. 2 and 1. Rod 24 may also be a telescoping rod as shown in the drawings where a thinner and more flexible outer rod 27 may be secured in place by tightening knob 28. Similarly, rod 29 is supported by fixture 20 and telescopingly holds outer rod 30 which is secured in place by tightening knob 31. The golfer is shown in front view in FIG. 1 and indicated by reference character 31. The golfer's head 32 is touched by rods 27 and 30. The rods may be moved and tend to stay in place since they are respectively held by nuts 33 and 34. The club 35 may be given a full swing and in fact, golf ball 36 may be driven while using the training apparatus of the present invention. Preferably the rods are protected by a small ball 37 and 38 at the tip thereof for safety purposes.

The result is a training apparatus which may be inexpensively manufactured and easily used which nonetheless is very effective in training a golfer to eliminate one of the most common mistakes that golfers make, namely, moving one's head during a swing.

The device may be inexpensively fabricated from plastic rods and may be adjusted for any height of golfer.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A training apparatus for golfers which assists the golfer to hold the golfer's head steady during a swing, said apparatus comprising:

a stand supported on the ground, said stand including a first and a second rod-supporting fixture held at about shoulder height to a golfer using the device;

a first thin, flexible rod held by said first rod-supporting fixture and extending about horizontally outwardly therefrom, said first rod-supporting fixture permitting the first thin, flexible rod to be adjustably positioned; and a second thin, flexible rod held by said second rod-supporting fixture and extending about horizontally outwardly therefrom, said second rod-supporting fixture permitting the second thin, flexible rod to be adjustably positioned independently from said first thin, flexible rod thereby permitting the user to make a full swing with the rods adjacent the sides of the user's head to assist the golfer to maintain a stable head position during swing.

2. The training apparatus for golfers of claim 1 wherein said first and second rod supporting fixtures are ball and socket fixtures.

3. The training apparatus for golfers of claim 1 wherein said stand has a U-shaped base and a vertical telescoping shaft which supports an upper U-shaped member having two termini with a rod supporting fixture at the two termini thereof.

4. The training apparatus for golfers of claim 1 wherein said first and second thin, flexible rods have a safety ball at an outer end thereof.

* * * * *